US007913895B2

(12) United States Patent
Bowden et al.

(10) Patent No.: US 7,913,895 B2
(45) Date of Patent: Mar. 29, 2011

(54) PROTECTIVE WRAPPING PAPER FOR ROLLS AND METHODS FOR USING SAME

(75) Inventors: Richard Scott Bowden, Tolland, CT (US); Denis Aumais, Kingsey Falls (CA); Michel Labbé, Victoriaville (CA)

(73) Assignee: Cascades Conversion, Inc. (CA)

( * ) Notice: Subject to any disclaimer, the term of this patent is extended or adjusted under 35 U.S.C. 154(b) by 1 day.

(21) Appl. No.: 11/416,153

(22) Filed: May 2, 2006

(65) Prior Publication Data

US 2006/0277866 A1 Dec. 14, 2006

Related U.S. Application Data

(60) Provisional application No. 60/676,962, filed on May 3, 2005.

(51) Int. Cl.
*B65D 65/00* (2006.01)
*B65B 11/00* (2006.01)

(52) U.S. Cl. ..... 229/87.01; 53/210; 53/463; 53/465; 206/389; 206/397; 428/343; 428/346; 428/347; 428/354; 428/77; 229/92.7

(58) Field of Classification Search ..... 428/343, 428/347, 350, 345, 346, 351, 511, 537.5
See application file for complete search history.

(56) References Cited

U.S. PATENT DOCUMENTS

| | | | | |
|---|---|---|---|---|
| 2,510,120 | A * | 6/1950 | Leander | 428/191 |
| 3,862,099 | A * | 1/1975 | Marans | 524/204 |
| 4,858,762 | A * | 8/1989 | Kewin | 206/414 |
| 5,090,566 | A | 2/1992 | Yount | |
| 5,114,012 | A | 5/1992 | Mushinski et al. | |
| 5,131,209 | A | 7/1992 | Schreiber et al. | |
| 5,392,585 | A * | 2/1995 | Wall | 53/136.2 |
| RE35,241 | E * | 5/1996 | Capy et al. | 426/111 |
| 5,850,918 | A | 12/1998 | Pienta | |
| 6,186,326 | B1 | 2/2001 | Pienta et al. | |
| 6,446,804 | B1 | 9/2002 | Lehtineva | |
| 2002/0090508 | A1 * | 7/2002 | Nowak et al. | 428/342 |
| 2002/0192406 | A1 * | 12/2002 | Labbe et al. | 428/34.2 |
| 2006/0277866 | A1 | 12/2006 | Bowden | |
| 2007/0272574 | A1 | 11/2007 | Uitenbroek | |
| 2009/0078748 | A1 * | 3/2009 | Labbe et al. | 229/87.01 |

FOREIGN PATENT DOCUMENTS

| | | |
|---|---|---|
| CA | 2153394 | 7/1994 |

OTHER PUBLICATIONS

European Search Report dated Sep. 14, 2009 for European Application No. 08 16 5169.7.
Disclosure Statement Under 37 C.F.R. § 1.56 for U.S. Appl. No. 11/416,153.

* cited by examiner

*Primary Examiner* — Callie E Shosho
*Assistant Examiner* — Anish Desai
(74) *Attorney, Agent, or Firm* — Sutherland Asbill & Brennan LLP

(57) ABSTRACT

A wrapping paper for a roll having two opposed roll ends, the wrapping paper includes: a paper layer; and at least one exposed strip having adhesive properties. The at least one exposed strip is proximate to a side edge of the paper layer and covers at least a portion of one of the roll ends when wrapped around the roll. A method for wrapping a roll having a pair of spaced roll ends and an outer roll surface extending between the roll ends.

16 Claims, 4 Drawing Sheets

PROTECTIVE WRAPPING PAPER FOR ROLLS AND METHODS FOR USING SAME

CROSS-REFERENCE TO RELATED APPLICATIONS

This application claims priority of U.S. provisional patent application 60/676,962 filed May 3, 2005, the specification of which is hereby incorporated by reference.

FIELD OF THE INVENTION

The present invention relates to protective wrapping papers for rolls to prevent penetration by liquid, such as water, and, more particularly, to protective wrapping papers that provide impervious roll ends.

DESCRIPTION OF THE PRIOR ART

Newsprint and other forms of paper are manufactured and processed as large elongated sheets or webs. For storage and transport, the paper stock is wrapped around a core plug to form a cylindrical roll. The rolls are very heavy. A typical roll may range from 25 to 72 inches in diameter and, sometimes, as large as 145 inches or more. To protect the roll from moisture, the atmosphere, and physical abrasions, the roll itself is wrapped in a moisture proof protective wrapping. Typically the rolls are then stacked one on the other and stored on end. Specialized machinery must be employed to automatically apply wrapping paper to the large rolls.

Various methods have previously been used to wrap paper rolls. One of the most successful methods has been to first wrap the roll in one or two layers of a protective wrapping paper, with the wrapping paper extending outwardly beyond the ends of the roll. Next, interior roll headers (disks formed of corrugated cardboard, chipboard, coated chipboard or laminated kraft paper) are fitted inside the wrapping paper against the ends of the roll. The wrapping paper is then crimped over the edges of the interior headers at the ends of the rolls using a crimping wheel or any other appropriate technique. A set of exterior or outside roll headers (somewhat thinner disks typically formed of a kraft paper with a polymer coating on the inside surface) are then attached to the ends of the roll over the crimped edges. The headers and the wrapping paper are held in place and affixed to one another through the use of an adhesive, such as a heat sensitive adhesive (a polymer coating), on the inside surface of the exterior roll header and/or the outward face of the interior roll header.

The exterior roll headers are affixed to the ends of the rolls in a typical roll wrapping machine by applying heat and/or pressure in accordance with the properties of the adhesive used.

However, with the technique described above, the wrapping paper is not perfectly sealed at the ends of the rolls, even though the wrapping paper and the headers, if any, are rendered watertight due to polymeric coatings. Channels are formed in the crimps, i.e. crimp tunnels, that allow liquid infiltration along the crimps when the wrapped paper roll is in contact with liquids during storage and, more particularly, transport. The infiltrated liquid flows towards the interior header and the paper roll, causing damages to the later. Damage typically happens during roll transportation, transit, and warehousing when environmental water (rail, sleet, snow, water puddles along the route, etc.) enters the trailer or boxcar through defective walls, floors, and doors. Infiltration occurs through the end of the wrapped roll, notwithstanding use of watertight wrapper and headers, because the wrapped roll is standing on its end on a floor that is often getting wet during transit. Damage to the paper rolls incurs financial burden to the purchaser, the manufacturer, and/or the transporter.

BRIEF SUMMARY OF THE INVENTION

It is therefore an aim of the present invention to address the above mentioned issues.

An aspect of the invention provides a wrapping paper for a roll having two opposed roll ends. The wrapping paper comprises: a paper layer; and at least one exposed strip having adhesive properties. The at least one exposed strip is proximate to a side edge of the paper layer and covers at least a portion of one of the roll ends when wrapped around the roll.

Another aspect of the invention provides a method for wrapping a roll having a pair of spaced-apart roll ends and an outer roll surface extending between the roll ends. The method comprises: wrapping the roll with a wrapping paper having at least one exposable adhesive strip provided along a side edge strip thereof, the at least one exposable adhesive strip extending axially beyond a respective one of the roll ends after the roll has been wrapped; folding the side edge strip towards the respective one of roll ends; and sealing the folded side edge strip by creating adhesive-to-adhesive bonds with the exposable adhesive strip.

A further aspect of the invention provides a wrapped roll. The wrapped roll comprises: a roll having two spaced-apart roll ends and an outer roll surface extending between the roll ends; and a wrapping paper having a first section covering the outer surface of the roll and a second section covering at least a portion of a respective one of the roll ends, the second section having adhesive properties over at least a portion thereof, the second section forming overlapped portions providing adhesive-to-adhesive sealing bonds.

Another aspect of the invention provides a method for wrapping a roll having a pair of spaced-apart roll ends and an outer roll surface extending between the roll ends. The method comprises: exposing at least one exposable adhesive strip along a side edge strip of a wrapping paper for wrapping the roll therein; wrapping the roll with the wrapping paper, the at least one exposable adhesive strip extending axially beyond one of the roll ends after the roll has been wrapped; folding the side edge strip towards the respective roll end; and sealing the folded edge strip by creating adhesive-to-adhesive bonds with the exposable adhesive strip.

Another aspect of the invention provides a method for shipping a roll having a pair of spaced-apart roll ends and an outer roll surface extending between the roll ends. The method comprises: wrapping the roll with a wrapping paper having at least one exposable adhesive strip provided along a side edge strip thereof, the at least one exposable adhesive strip extending axially beyond a respective one of the roll ends after the roll has been wrapped; folding the side edge strip towards the respective one of the roll ends; sealing the folded edge strip by creating adhesive-to-adhesive bonds with the exposable adhesive strip; and storing the wrapped roll in a carrier for shipping with the wrapped roll lying on the respective one of the roll ends.

According to a general aspect, there is provided a protective roll wrap for wrapping a paper roll having a first roll end and a second roll end opposite to the first roll end. The protective roll wrap comprises: a wrapper having a first edge strip for forming a first crimp on the first roll end, a second edge strip for forming a second crimp on the second roll end, and a peripheral strip extending between the first edge strip and the second edge strip, the wrapper having a first paper layer with a width W1 and a second paper layer with a width W3, the width W1 being wider than the width W3, a heat sensitive adhesive layer extending between the first and the second paper layers and having a width W2 wider than the width W3, thereby providing at least one exposed adhesive strip extending at least partially along at least one of the first and the second edge strips, wherein crimping one of the first and the second edge strips having the at least one exposed adhesive strip creates overlapped sections with interior folds having sections of the exposed adhesive strip facing each other in adhesive-to-adhesive contact and activating the heat sensitive adhesive layer seals the interior folds preventing liquid infiltration between the overlapped sections.

According to another general aspect, there is provided a protective roll wrapper for wrapping a roll having a first roll end and a second roll end opposite to the first roll end. The protective roll wrapper comprises: a first edge strip crimpable to the first roll end, a second edge strip crimpable to the second roll end, a peripheral strip extending between the first edge strip and the second edge strip, the protective wrapper having a first paper layer having a width W1 and a second paper layer having a width W3, the width W1 being wider than the width W3, a heat sensitive adhesive layer extending between the first and the second paper layers and having a width W2 wider than the width W3, thereby providing at least one exposed adhesive strip of the heat sensitive adhesive layer along at least one of the first and the second edge strips, two sections of the at least one exposed adhesive strip overlapping and facing one another when crimped to a respective one of the first and the second roll ends and, when the heat sensitive adhesive layer is activated, sealing the overlapping sections of the at least one exposed adhesive strip to one another and preventing liquid infiltration therebetween.

BRIEF DESCRIPTION OF THE DRAWINGS

It will be noted that throughout the appended drawings, like features are identified by like reference numerals.

DETAILED DESCRIPTION

Figure 1:
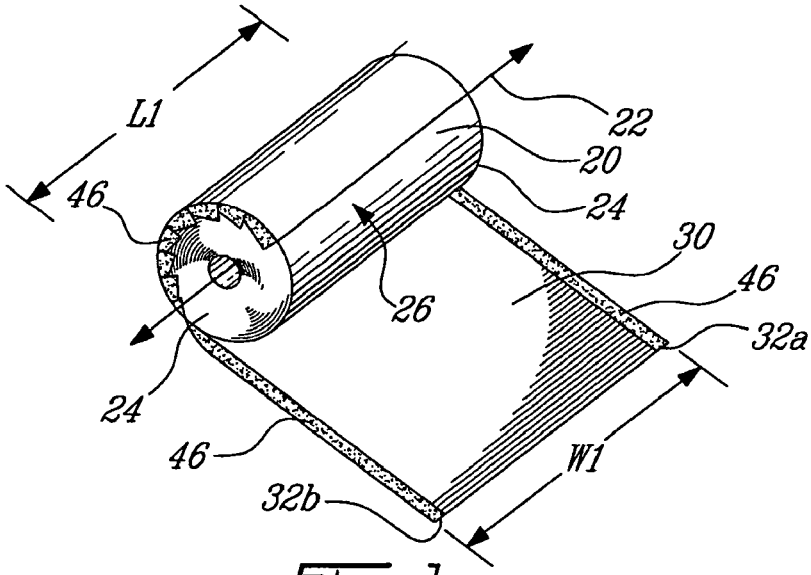
FIG. 1 is a perspective view of a paper roll being wrapped in accordance with an embodiment of the invention.
Figure 2:
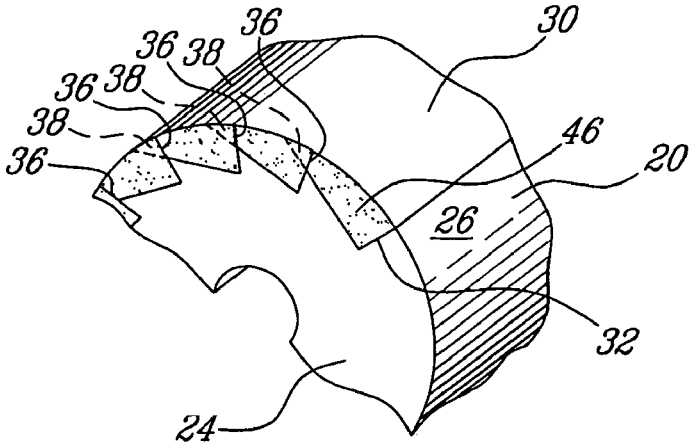
FIG. 2 is a perspective view, fragmented, of a roll end of the paper roll shown in FIG. 1.

Referring now to the drawings and, more particularly, to FIGS. 1 and 2, there is shown a conventional paper roll 20 having a longitudinal roll axis 22, a pair of longitudinally spaced-apart roll ends 24, and an outer roll surface 26 extending between the roll ends 24 and radially spaced along the longitudinal roll axis 22. The roll 20 is characterized by a length L1 along the longitudinal roll axis 22.

The roll 20 is wrapped with a protective wrapping paper 30 having a width W1, longer than the length L1, in a manner such that longitudinal edge strips 32*a*, 32*b* of the wrapping paper 30 extend outwardly beyond the roll ends 24. The edge strips 32*a*, 32*b* of the wrapping paper 30 typically extend between three to ten inches and, preferably, between four to nine inches, beyond the roll ends 24 but that they can be wider or narrower.

Figure 8:
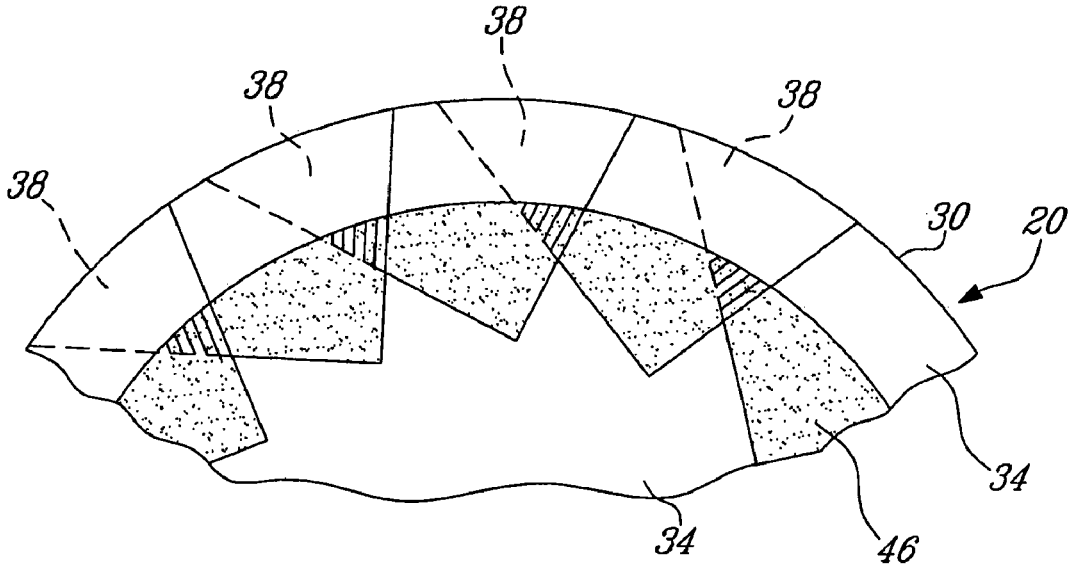
FIG. 8 is a top plan view, fragmented, of a roll end of the paper roll wrapped in the wrapping paper shown in FIG. 3.

The edge strips 32*a*, 32*b* are crimped using a crimping wheel which hammers the edge strips 32*a*, 32*b* onto the ends 24 of the roll 20. It will appreciate that any other suitable technique can be used to crimp the extending edge strips 32*a*, 32*b*. Each of the edge strips 32*a*, 32*b* of the wrapping paper 30 overlap onto itself on the roll ends 24 during the crimping procedure. As the edge strips 32*a*, 32*b* are crimped over the roll ends 24, ridges 36 are produced and part of the wrapping paper 30 overlaps onto itself forming overlapped areas 38 (FIGS. 2 and 8). Crimp tunnels (not shown) are defined between the overlapped areas 38 of the wrapping paper 30. If not properly sealed, the crimp tunnels allow liquid infiltration towards the paper roll 20, causing damages to the later, even though the wrapping paper or wrapper and headers are rendered watertight due to polymeric coatings.

An exterior roll header 42 (FIGS. 10 and 11) is then secured to the roll ends 24 over the crimped edge strips 32*a*, 32*b* to complete the protection of the roll 20.

Figure 3:
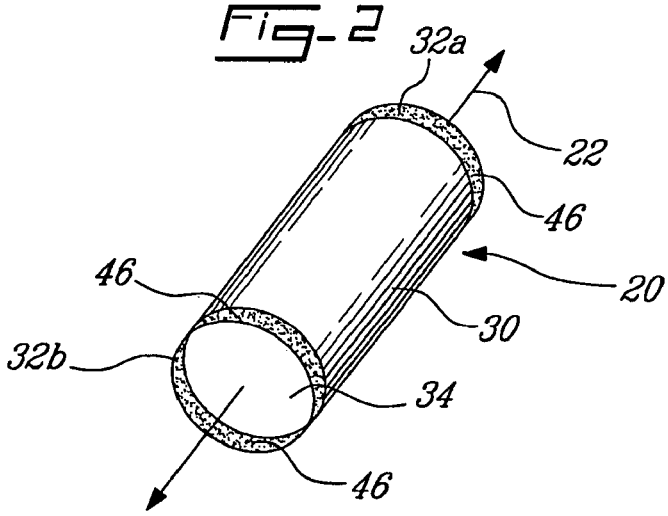
FIG. 3 is a perspective view of the paper roll wrapped in the wrapping paper of FIG. 1, wherein interior roll headers are juxtaposed to the roll ends.
Figure 10:
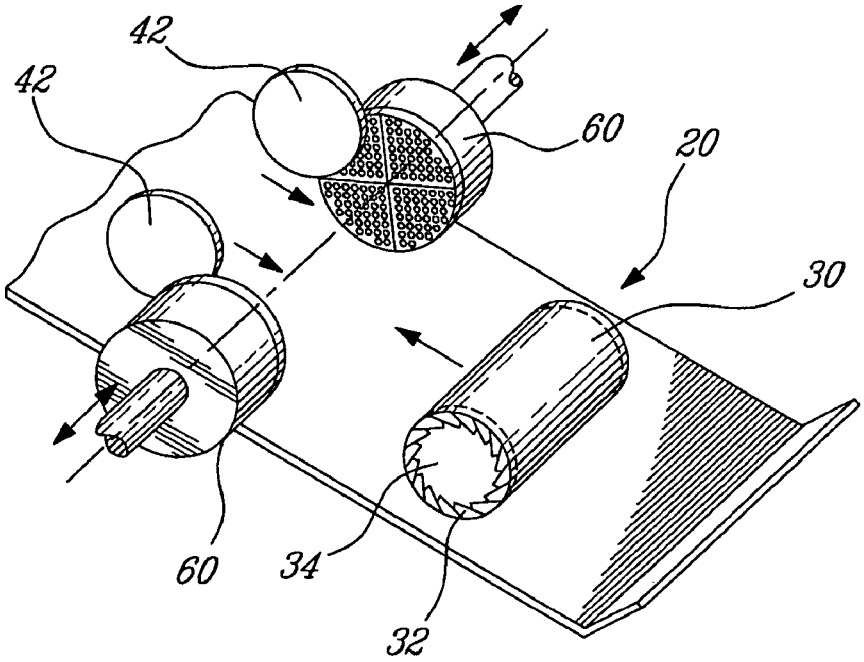
FIG. 10 is a perspective view of a header mounting apparatus showing the positioning of exterior roll headers in accordance with an embodiment of the invention.

Referring now to FIG. 3, it will be seen another embodiment wherein the roll 20 is wrapped into the wrapping paper 30. Either before or after the wrapping paper 30 has been applied to the roll 20, interior roll headers 34 (only one is shown) have been juxtaposed to the roll ends 24. The edge strips 32*a*, 32*b* extend beyond the interior roll headers 34. The extending edge strips 32*a*, 32*b* are crimped over the interior roll headers 34 (FIG. 10). The wrapping paper 30 and the interior roll headers 34 form an integral part in the protection of the roll 20.

The roll headers 34, 42 are disks formed of corrugated cardboard, chipboard, or laminated kraft paper, for example. The roll headers 34, 42 can have adhesive properties on a face. For example they can be coated with a heat sensitive adhesive such as polyethylene. For the interior roll header 34, the adhesive is on the face opposite to the face in contact with the roll 20, i.e. the face in contact with the crimped edge strips 32. For the exterior roll header 42, the adhesive is on the face in contact with the crimped edge strips 32. Therefore, when activated, if necessary, the adhesive bonds the roll headers 34, 42 to the crimped edge strips 32*a*, 32*b*, as it will be described in more details below.

Referring now simultaneously to FIGS. 1-3, it will be seen that, for wrapping the roll 20, the edge strips 32*a*, 32*b* of the wrapping paper 30 have an exposed strip 46 of a material with adhesive properties on both faces. The adhesive strip can be provided on the wrapping paper 30 either prior to wrapping the roll 20 or once the roll 20 is wrapped. It will appreciate that another material, with or without moisture barrier properties, can be laminated in between the exposed strips 46 to provide a protective wrapping paper 30 covering the outer roll surface 26.

Figure 4:
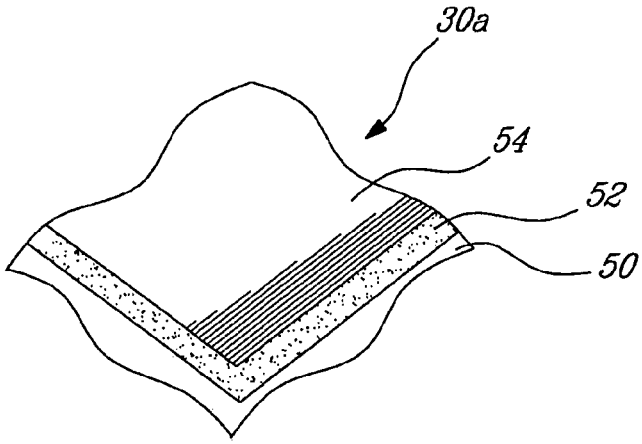
FIG. 4 is a perspective view, fragmented, of the wrapping paper in accordance with an embodiment of the invention, wherein portions of the constituting layers have been removed to show each layer.
Figure 5:
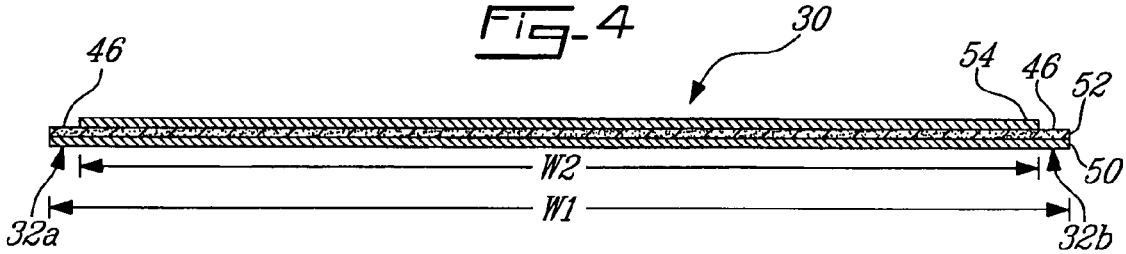
FIG. 5 is a cross-section view, enlarged, of the wrapping paper shown in FIG. 2.

Referring to FIGS. 4 and 5, it will be seen that the wrapping paper 30*a* can include a first layer 50 of a paper material, a layer 52 of a material having adhesive and moisture barrier properties, superposed to the first layer 50, and a second layer 54 of a paper material superposed to the layer 52. The layers 50, 52 have a width W1 while the layer 54 has a width W2, smaller than the width W1, thereby exposing the adhesive strips 46 along the edge strips 32*a*, 32*b*. On the opposite of the wrapping paper shown in FIG. 1, only one face of the wrapping paper 30*a* includes an exposed strip 46. When wrapping the roll 20, the exposed strip 46 can be located on the face of the wrapping paper 30 in contact with the interior roll header 34 or the end 24 of the paper roll 20 or in contact with the exterior roll header 42, if any, i.e. the outer face of the wrapping paper 30.

In alternative embodiments, the first layer 50 and the adhesive material layer 52 can have different widths. Therefore, either the resulting wrapping paper 30*a* has an exposed adhesive strip 46 along only one of the edge strips 32*a*, 32*b* or the width of the edge strips 32*a*, 32*b* and the width of the exposed adhesive strip 46 differ.

The width W2 of the second layer 54 is typically the same as the length L1 of the roll 20 being wrapped or is slightly longer. However, in an alternative embodiment, the width W2 of the second layer 54 is narrower than the length L1 of the roll 20. As mentioned above, the width of the first layer 50 is longer than the length L1, thus the edge strips 32*a*, 32*b* extend beyond the roll ends 24.

Figure 6:
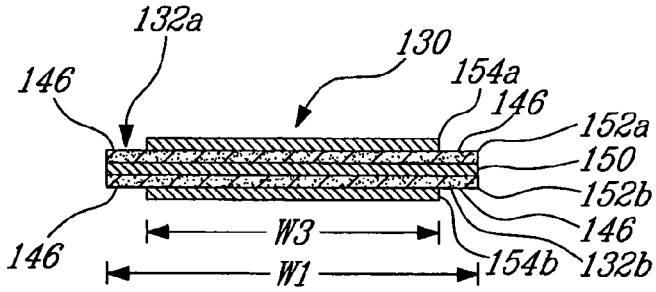
FIG. 6 is a cross-section view, enlarged, of a wrapping paper in accordance with another embodiment of the invention, the wrapper paper including five material layers and exposing an adhesive strip on both faces of the wrapping paper.

It will be appreciated that several other possibilities exist for the wrapping paper 30, 30*a*. Referring now to FIG. 6, another embodiment of the wrapping paper 30, 30*a* will be seen wherein the features are numbered with reference numerals in the 100 series which correspond to the reference numerals of the previous embodiments. As the embodiment shown in FIG. 1, the wrapping paper 130 has exposed adhesive strips 146 on both faces. The wrapping paper 130 includes a central paper layer 150 having a width W1, two adhesive layers 152*a*, 152*b* having a width W1, each adhesive layer 152*a*, 152*b* being applied on a respective face of the central paper layer 150, and two outer surface paper layers 154*a*, 154*b* having a width W3, narrower than the width W1, each outer surface paper layer 154*a*, 154*b* being applied to a face of a respective adhesive layer 152*a*, 152*b*. Since the width W3 of the outer surface paper layers 154*a*, 154*b* is narrower than the width W1 of the adhesive layers 152*a*, 152*b*, exposed adhesive strips 146 are provided along the edge strips 132*a*, 132*b* of the resulting wrapping paper 130.

In alternative embodiments, the width of the adhesive layers 152*a*, 152*b* is narrower than the width of the central paper layer 150 but wider than the width W3 of the outer surface paper layer 154*a*, 154*b*. Thus, the width of the edge strips 132*a*, 132*b* and the width of the exposed adhesive strips 146 differ. However, in an alternative embodiment, the width W3 of the second layers 154*a*, 154*b* can be narrower or wider than the length L1 of the roll 20. Moreover, the adhesive strip 146 can be provided along only one edge strip 132 of the wrapping paper 130.

Figure 7:
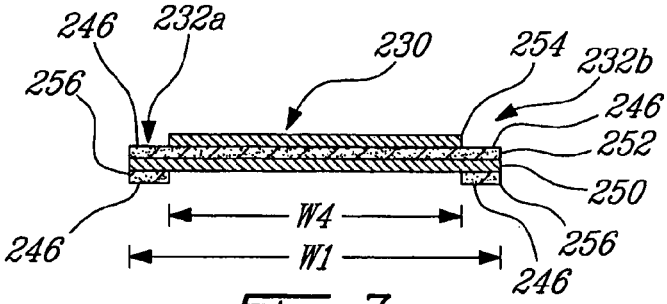
FIG. 7 is a cross-section view, enlarged, of a wrapping paper in accordance with another embodiment of the invention, the wrapper paper including four material layers and exposing an adhesive strip on both faces of the wrapping paper.

Referring now to FIG. 7, another embodiment of the wrapping paper 30, 30*a*, 130 will be seen wherein the features are numbered with reference numerals in the 200 series which correspond to the reference numerals of the previous embodiments. As for the embodiments described in reference to FIGS. 1 and 6, the wrapping paper 230 has exposed adhesive strips 246 on both faces. The wrapping paper 230 includes a first paper layer 250 having a width W1, an adhesive layer 252 having a width W1 and being applied to a first face of the paper layer 250, a second paper layer 254 having a width W4, narrower than the width W1, and being applied to the adhesive layer 252, and two bands 256 of a material having adhesive properties secured to a second face of the first paper layer 250, over the edge strips 232*a*, 232*b*. Since the width W4 of the outer surface paper layer 254*b* is narrower than the width W1 of the adhesive layer 152, exposed adhesive strips 246 are provided along the edge strips 232*a*, 232*b* of the resulting wrapping paper 230, the adhesive bands 256 providing exposed adhesive strips 246 on the second face of the wrapping paper 230.

The bands 256 can be provided by securing a separate band (not shown) of wrapper carrying the strip of adhesive material over at least a portion of the edge strips 232 of the wrapping paper 230 during or after the application of the wrapping paper 230 to the roll 20.

As for the previously described embodiments, in alternative embodiments, the width of the edge strips 232*a*, 232*b* and the width of the exposed adhesive strips 246 can differ by adjusting the width of the adhesive layer 252 and the adhesive bands 256 relatively to the width of the first paper layer 250.

The adhesive material can be an activated adhesive in a manner such that the wrapping paper 30, 30*a*, 130, 230 can be manipulated easily for wrapping the roll 20. When the roll 20 is wrapped, the adhesive is activated to seal the crimped tunnels of the wrapping paper 30. For example, the adhesive can be a heat or a pressure sensitive adhesive. The adhesive material can be a polymer which is laminated on the paper layer (polymer coating). For example, a heat sensitive adhesive can be EMA, EVA, polyurethane, polyethylene, polypropylene, high density polyethylene, and any other suitable heat-sealable resin. The adhesive can also be multilayered such as EMA/polyethylene, EVA/polyethylene, polyethylene/high density polyethylene, and the like. The adhesive can also be activated by other energy sources such as, but not limited to, ultraviolet light, infrared energy, microwaves, radiowaves, ultrasound, radioactivity, radiofrequency or chemical reaction.

The adhesive material can be applied to the paper layers 50, 150, 250 by extrusion or water coating, solventless coating (or 100% solid coating, spraying or any other suitable technique.

The paper layers 50, 150, 250 can be any conventional type of flexible paper or cardboard used for wrapping. For example, it can be a laminated paper, a virgin kraft paper, a recycled paper, and the like.

For protecting the roll 20 from external moisture, the atmosphere, and physical abrasions, the wrapping paper 30, 30*a*, 130, 230 can have moisture proof properties along its width W1. The adhesive material can be selected to provide the moisture proof properties to the wrapping paper 30, 30*a*, 130, 230. In that case, the adhesive material can cover the wrapping paper 30, 30*a*, 130, 230 along its entire width W1, as shown in FIGS. 5-7.

If the adhesive does not cover the paper layer along its entire width or if the adhesive does not have sufficient moisture barrier properties, the paper layers can be laminated with a material having moisture barrier properties such as wax, an appropriate polymer or any other appropriate material.

Referring now to FIG. 8, it will be seen that once the roll 20 is wrapped in the wrapping paper 30, the edge strips 32*a*, 32*b* are crimped over interior headers 34, juxtaposed to the roll ends 24. As mentioned above, crimping the edge strips 32 over the interior headers 34 forms overlapped areas 38 of wrapping paper 30 and crimp tunnels, between the overlapped areas 38.

The overlapping areas 38 provide an adhesive to adhesive juxtaposition or contact since a section of the exposed adhesive strip 46 is juxtaposed to another section of the exposed adhesive strip 46. Adhesive-to-adhesive contact provides stronger bonds between two members and better barrier properties. Therefore, when activated, if necessary, the overlapped sections 38 of the exposed adhesive strips 46 bond tightly together. The adhesive-to-adhesive juxtaposition of the exposed adhesive strips 46 seals the crimp tunnels defined in the overlapped areas 38, thereby preventing liquid infiltration therein.

Then the exterior roll header 42 is applied and secured to the outward face of the crimped edge strips 32 to complete the protection of the roll 20.

If the adhesive strip 46 is provided on the face, opposite to the face in contact with the roll 20, adhesive is provided outwardly of the wrapping paper 30, in contact with the exterior roll header 42, if any, and also into the interior folds of each crimp in an adhesive-to-adhesive contact. On the opposite, if the adhesive strip 46 is provided on the face in contact with the roll 20, adhesive is provided in contact with the interior roll header 34, if any, and also into the interior folds of each crimp in adhesive-to-adhesive contact. When the adhesive is activated, if necessary, the adhesive-to-adhesive contact and the adhesive-to-paper contacts seal the assembly and physically prevents the formation of channels or tunnels for liquid infiltration into the ends of the wrapped roll 20.

The adhesive of the header 34, 42, if any, is in an adhesive-to-adhesive contact if the header 34, 42 is juxtaposed to a face of the wrapping paper 30 including an adhesive strip 46, thereby providing stronger bond and improved barrier properties between the header 34, 42 and the wrapping paper 30.

In alternative embodiments, the edge strips 32 are crimped directly over the roll ends 24 and/or no exterior roll header 42 is applied to the outward face of the crimped edge strips 32.

Figure 9:
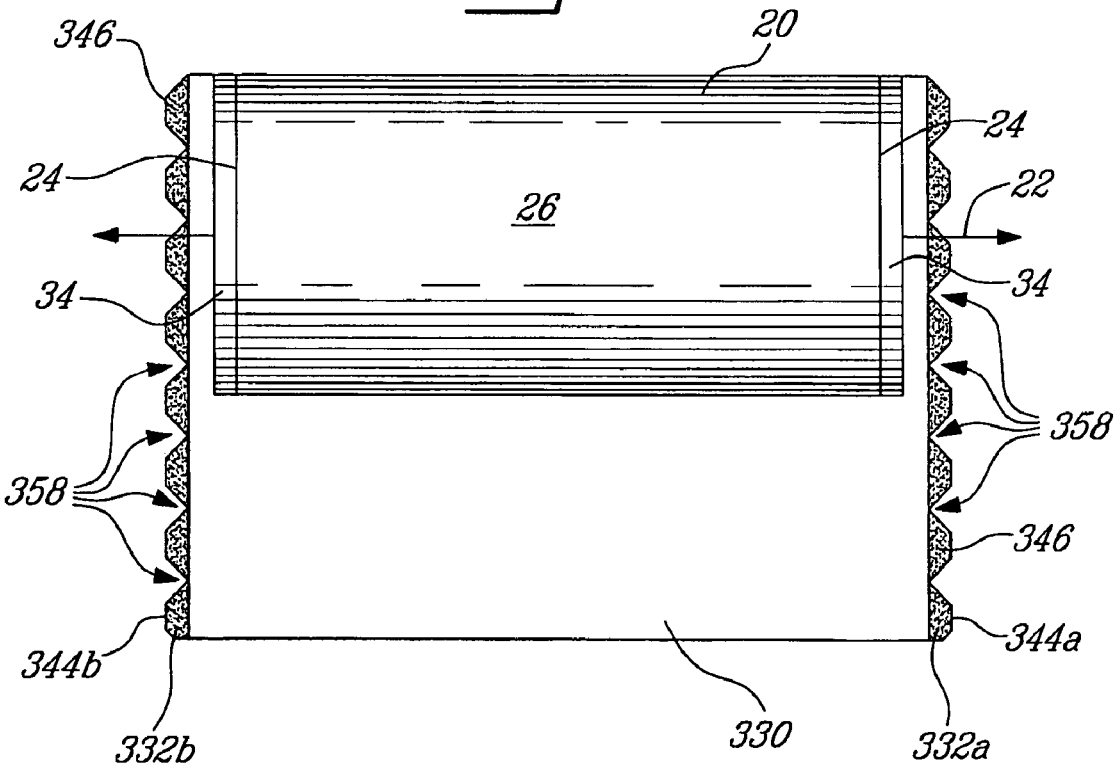
FIG. 9 is a top plan view of the paper roll being wrapped with a wrapping paper having waved edges in accordance with an embodiment of the invention.

Referring now to FIG. 9, another embodiment of the wrapping paper 30, 30*a*, 130, 230 will be seen wherein the features are numbered with reference numerals in the 300 series which correspond to the reference numerals of the previous embodiments. On the opposite of FIGS. 1 and 3, the edges of the wrapping paper 330 are not straight edges, the edges 344*a*, 344*b* of the wrapping paper 330 are waved edges. The height of the ridges produced when the edge strips 332*a*, 332*b* are folded towards the roll ends 24 of the roll 20 with the waved edges is reduced. In the embodiment shown in FIG. 9, the waved edges are V-shaped grooves 358 cut into the edges 344 of the wrapping paper 330 and thereby forming substantially trapezoidal edges. The depth of the V-shaped grooves 358 can vary depending upon the characteristics of the wrapping paper 330. The V-shaped grooves 358 cut along the edges 344 of the wrapping paper 330 reduce the severity of the indentation produced by the ridges from the wrapping paper overlapped areas 338. In the embodiments shown, the V-shaped grooves 358 do not cut into the entire width of the edge strips 322*a*, 322*b*. The groove 358 extends over a shorter portion than the edge strips 322*a*, 322*b* to provide sufficient edge protection and a sufficient moisture barrier. In another embodiment, the V-shaped grooves 358 can be replaced by U-shaped grooves (not shown) or any other groove shape provided in the edges 344 of the wrapping paper 330.

As for the previously described embodiments, at least one face of the wrapping paper 330 is provided with at least one exposed adhesive strip 346 along at least one of the edge strips 322. When folded towards the roll ends 24, the overlapped areas of the exposed adhesive strip 346 are in adhesive to adhesive contact, thereby providing improved barrier properties. The face of the roll headers 34, 42 juxtaposed to the exposed adhesive strips 346 can also include adhesive properties for providing improved barrier properties.

As mentioned above, the adhesive material of the adhesive strip 46, 146, 246, 346 can be an activated adhesive such as an heat activated adhesive. The adhesive properties of the adhesive strip 46, 146, 246, 346 can be activated by any suitable technique. For example, it can be activated by heat, infrared, ultraviolet light, ultrasound, pressure, microwaves, radiowaves, X-rays and any other suitable source to activate adhesives. As mentioned above, the roll headers 34, 42 can be coated on one side with an adhesive such as polyethylene, which bonds the roll headers 34, 42 to the wrapping paper 30, 30*a*, 130, 230, 330, in an adhesive to adhesive contact.

Figure 11:
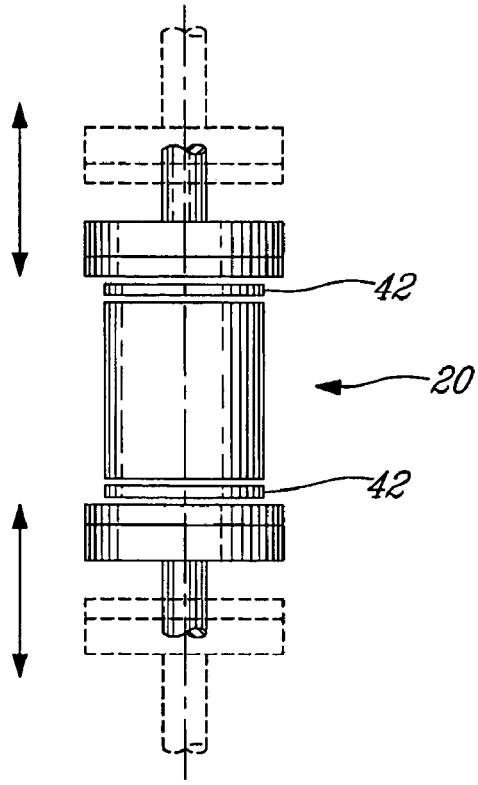
FIG. 11 is a side elevation view of the header mounting apparatus shown in FIG. 10 showing the roll being sandwiched between two exterior roll headers.

For example, referring simultaneously to FIGS. 10 and 11, there is shown that the heat can be supplied from header heat plates 60. The header heat plates 60 simultaneously activate the heat sensitive adhesive on the adhesive strip 46, 146, 246, 346 and the roll headers 34, 42, if any. They also apply pressure to the exterior roll headers 42, if any, to bond the wrapping assembly together. After the roll headers 34, 42 have been pressed onto the ends 24 of the roll 20, the header plate 60 are pulled laterally away from the roll 20 to allow removal of the roll 20 therefrom. The temperature for the activation of the adhesive, the pressure applied, and the time required to obtain adequate bonds depend on the nature of the adhesive and the paper used. For example, without being limitative, the temperature can vary between 325-425° F., the pressing time can vary between 1-40 seconds, the heating time can vary between 5-60 seconds.

The roll ends 24, along the lengths of the crimps, of the wrapped rolls obtained with the wrapping papers 30, 30*a*, 130, 230, 330 described above are watertight. This prevents liquid infiltration along the crimps. Adhesive-to-adhesive contacts provide impervious roll ends that prevent water infiltration through crimp tunnels.

The roll 20 can be any type of rolled paper including coated printing paper. However, it will appreciate that the above described technique and wrapping paper can be applied to any rolled material that needs to be wrapped and protected from liquids and/or moisture infiltration.

The wrapping paper 30, 30*a*, 130, 230, 330 can be manufactured on existing roll wrap extruders, laminators, and coater-laminators and can be applied to the roll 20 with existing roll wrapping equipments.

It will appreciate that the roll 20 can be wrapped one turn or more by the wrapping paper 30, 30*a*, 130, 230, 330 depending upon the physical properties of the wrapping paper 30, 30*a*, 130, 230, 330.

In an embodiment, only one edge strip 32*a*, 32*b* has an exposed strip 46 of a material having adhesive properties, the end 24 on which the exposed strip 46 is crimped is in contact with the floor during storage and transport.

The nature of the adhesive material used for the adhesive strips 46 and the headers 34, 42, if any, can be the same or a different one.

The embodiments of the invention described above are intended to be exemplary only. Several alternatives are possible. For example, it is possible to wrap the roll 20 without using one of or both headers 34, 42. The protective wrapping paper 30, 30*a*, 130, 230, 330 could be used to protect various moisture sensitive articles not only paper rolls.

In the embodiments described above, the adhesive strip 46, 146, 246, 346 is juxtaposed to the edge of the wrapping paper 30, 30*a*, 130, 230, 330. In alternative embodiment, a spacing could be provided between the adhesive strip 46, 146, 246, 346 and the edge of the wrapping paper 30, 30*a*, 130, 230, 330. Moreover, the adhesive strip 46, 146, 246, 346 can be wider or narrower than the edge strips 22, 122, 222, 322.

The length, the shape, and the position of the adhesive strip 46, 146, 246, 346 on the wrapping paper 30, 30*a*, 130, 230, 330 can vary provided that the strip 46, 146, 246, 346 extends axially beyond a roll end when the wrapping paper is wrapped around the roll, and covers at least a portion of one of the roll ends. Furthermore, the constitution of the wrapping paper 30, 30*a*, 130, 230, 330 can vary from those described above.

Many modifications and other embodiments of the inventions set forth herein will come to mind to one skilled in the art to which these inventions pertain having the benefit of the teachings presented in the foregoing descriptions and the associated attachments. Therefore, it is to be understood that the inventions are not to be limited to the specific embodiments disclosed and that modifications and other embodiments are intended to be included within the scope of the present disclosure. Although specific terms are employed herein, they are used in a generic and descriptive sense only and not for purposes of limitation. The scope of the invention is therefore intended to be limited solely by the scope of the appended claims.

The invention claimed is:

1. A protective roll wrap for wrapping a paper roll having a first roll end and a second roll end opposite to the first roll end, the protective roll wrap comprising: a wrapper having a first edge strip for forming a first crimp on the first roll end, a second edge strip for forming a second crimp on the second roll end, and a peripheral strip extending between the first edge strip and the second edge strip, the wrapper having a first paper layer with a width W1 and a second paper layer with a width W3, the width W1 being wider than the width W3, a heat sensitive adhesive layer extending between the first and the second paper layers and having a width W2 wider than the width W3, thereby providing at least one exposed adhesive strip extending at least partially along at least one of the first and the second edge strips, wherein crimping one of the first and the second edge strips having the at least one exposed adhesive strip creates overlapped sections with interior folds having sections of the exposed adhesive strip facing each other in adhesive-to-adhesive contact and activating the heat sensitive adhesive layer seals the interior folds preventing liquid infiltration between the overlapped sections.

2. The protective roll wrap as claimed in claim 1, wherein the first paper layer extends along the peripheral strip and the first and the second edge strips, the second paper layer extends along the peripheral strip and is narrower than the first paper layer, and the heat sensitive adhesive layer extends along the peripheral strip and the first and the second edge strips and between the first and the second paper layers, thereby providing the exposed adhesive strips of the heat sensitive adhesive layer in the first and the second edge strips.

3. The protective roll wrap as claimed in claim 1, wherein the first edge strip of the wrapper comprises two exposed adhesive strips, located on opposite sides of the wrapper.

4. The protective roll wrap as claimed in claim 1, wherein the heat sensitive adhesive layer extends over the first paper layer and provides moisture barrier properties to the wrapper.

5. The protective roll wrap as claimed in claim 1, wherein the heat sensitive adhesive layer is activated by heating.

6. The protective roll wrap as claimed in claim 1, wherein the heat sensitive adhesive layer comprises a thermoplastic adhesive.

7. The protective roll wrap as claimed in claim 1, wherein the width W1 is at least equal to the width W1.

8. The protective roll wrap as claimed in claim 1, wherein only the first edge strip comprises an exposed adhesive strip.

9. A protective roll wrapper for wrapping a roll having a first roll end and a second roll end opposite to the first roll end, the protective roll wrapper comprising: a first edge strip crimpable to the first roll end, a second edge strip crimpable to the second roll end, a peripheral strip extending between the first edge strip and the second edge strip, the protective wrapper having a first paper layer having a width W1 and a second paper layer having a width W3, the width W1 being wider than the width W3, a heat sensitive adhesive layer extending between the first and the second paper layers and having a width W2 wider than the width W3, thereby providing at least one exposed adhesive strip of the heat sensitive adhesive layer along at least one of the first and the second edge strips, two sections of the at least one exposed adhesive strip overlapping and facing one another when crimped to a respective one of the first and the second roll ends and, when the heat sensitive adhesive layer is activated, sealing the overlapping sections of the at least one exposed adhesive strip to one another and preventing liquid infiltration therebetween.

10. The protective roll wrapper as claimed in claim 9, wherein each one of the first and the second edge strips have at least one of the exposed adhesive strips.

11. The protective roll wrapper as claimed in claim 9, wherein the first edge strip of the wrapper comprises two exposed adhesive strips, located on opposite sides of the wrapper.

12. The protective roll wrapper as claimed in claim 9, wherein the heat sensitive adhesive layer extends over the first paper layer and provides moisture barrier properties to the wrapper.

13. The protective roll wrapper as claimed in claim 9, wherein the heat sensitive adhesive layer is activated by heating.

14. The protective roll wrapper as claimed in claim 9, wherein the heat sensitive adhesive is selected from the group consisting of EMA, EVA, polyurethane, polyethylene, polypropylene and high density polyethylene.

15. The protective roll wrapper as claimed in claim 9, wherein the width W1 is at least equal to the width W2.

16. The protective roll wrapper as claimed in claim 9, wherein only the first edge strip comprises an exposed adhesive strip.

* * * * *